US007572106B2

(12) United States Patent
Nagao et al.

(10) Patent No.: US 7,572,106 B2
(45) Date of Patent: Aug. 11, 2009

(54) INK PUMPING APPARATUS FOR PRINTING PRESS AND INK LEAK PREVENTING METHOD

(75) Inventors: Nobuaki Nagao, Kawasaki (JP); Akira Ueda, Tokyo (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 787 days.

(21) Appl. No.: 11/011,939

(22) Filed: Dec. 14, 2004

(65) Prior Publication Data

US 2005/0200665 A1 Sep. 15, 2005

(30) Foreign Application Priority Data

Mar. 9, 2004 (JP) ..... 2004-065209

(51) Int. Cl.
*F04B 49/06* (2006.01)
*F04B 49/22* (2006.01)
*F04B 7/06* (2006.01)

(52) U.S. Cl. ..... 417/53; 417/289; 417/500; 101/366

(58) Field of Classification Search ..... 417/500, 417/492, 53, 461, 289
See application file for complete search history.

(56) References Cited

U.S. PATENT DOCUMENTS 3,636,873 A * 1/1972 Fusco ..... 101/366
5,312,233 A * 5/1994 Tanny et al. ..... 417/316
6,336,405 B1 * 1/2002 Kawata et al. ..... 101/480
6,719,542 B2 * 4/2004 Shibuya ..... 417/490
2002/0197164 A1 * 12/2002 Hogan et al. ..... 417/20
2003/0116043 A1 * 6/2003 Uera et al. ..... 101/364

FOREIGN PATENT DOCUMENTS

| | | |
|---|---|---|
| JP | 49-86107 | 8/1974 |
| JP | S63-191276 | 12/1988 |
| JP | S64-3083 | 1/1989 |
| JP | 64-34235 | 3/1989 |
| JP | 3-79934 | 9/1991 |
| JP | 07-314647 | 12/1995 |
| JP | H7-323520 | 12/1995 |
| JP | 2864447 | 12/1998 |
| JP | 2002-349424 | 12/2002 |

* cited by examiner

*Primary Examiner*—Charles G Freay
(74) *Attorney, Agent, or Firm*—McGlew and Tuttle, P.C.

(57) ABSTRACT

It is intended to prevent ink from leaking through the ink outlet of the ink rail while the printing press is at halt. To achieve this object, a motor control section 40 shown in FIG. 4 controls the rotation of a stepping motor 15 driving a plunger 13 and, every time the stepping motor 15 is stopped, the outer circumference 13*c* of the plunger 13 except a cut portion 13*a* blocks at least a discharge port 18, thereby enabling the pressure ink invading from an intake port 17 into the main hole 11 of a cylinder 12 to press the plunger 13 against the discharge port 18 opening into the inner circumferential face of the main hole 11.

9 Claims, 9 Drawing Sheets

INK PUMPING APPARATUS FOR PRINTING PRESS AND INK LEAK PREVENTING METHOD

BACKGROUND OF THE INVENTION

1. Field of the Invention

The present invention relates to an ink pumping apparatus for printing press having ink pumps for supplying ink fountain roller of an inking mechanism having an ink rail with ink via the ink rail, and more particularly to an ink pumping apparatus for printing press having ink pumps each of which alternately sucks and discharges ink by reciprocating in the axial direction a plunger having a cut portion while rotating it, driven by a stepping motor, and an ink leak preventing method therefor.

2. Description of the Related Art

Ink pumping apparatus for printing press belonging to this technical field include those disclosed in, for instance, Patent Document 1 (Japanese Patent No. 2864447) and Patent Document 2 (Japanese Patent Application Laid-Open No. 2002-349424).

Each of the ink pumping apparatus for printing press disclosed in these Patent Documents (hereinafter referred to as simply "ink pumping apparatus(es)") has at least one ink pump, and this ink pump is so configured as to alternately accomplish a step of sucking and a step of discharging ink, once each at a time, while a plunger having a cut portion linked to an arm turned by a stepping motor once reciprocates in the main hole of a cylinder while making one turn.

Thus the plunger, while forcing its way into the main hole during its first 180 degrees of a turn, discharges ink through its discharge port. After that the plunger, while moving in the direction of getting out of the main hole during its second 180 degrees of the turn, sucks ink through its intake port. The apparatus further has detecting means which detects every arrival of the turning arm in a prescribed position, and can detect any abnormality in the operation of the pump from the advance or delay in the cycle of detection.

Further, in each of the ink pumping apparatus disclosed in the two Patent Documents, eight ink pumps and a driving motor are incorporated into a base to constitute one pump unit. The intake port of each ink pump is piped to an ink tank via an ink feed passage disposed in the base. Pressurized ink is fed from the ink tank into the ink feed passage. On the other hand, the discharge port of each ink pump is piped to the ink rail for feeding ink to the ink fountain roller.

In the ink sucking process, the plunger blocks the discharge port with its outer circumference except the cut portion, and sucks the pressurized ink into the main hole through the intake port. In the ink discharge process, the plunger blocks the intake port with the said outer circumference, discharges the ink in the main hole through the discharge port and through the ink outlet of the ink rail, and thereby feeds ink to the circumferential face of the ink fountain roller disposed close to the ink outlet.

Each of the stepping motors driving the ink pumps is driven to turn at a different speed from the others during the printing process according to an image area ratio, printing speed and other factors, and stopped at a stop instruction.

Therefore, when the ink pumps stop at a stop instruction, the plungers stop in disorderly phases of rotation, and the outer circumferences of some plungers except the cut portions block either of the intake port and the discharge port while those of others block both when they stop.

The ink pumping apparatus described above involve the following problems to be solved. In those disclosed in Patent Document 1 and Patent Document 2, the plunger of each ink pump is snapped into the main hole with a slight gap so that it can turn and shift in the axial direction within the main hole. Therefore, when the plunger stops with its outer circumference blocking the intake port, the pressure of the ink fed from the ink tank under pressure pushes the outer circumference blocking the intake port, the plunger is deformed within the main hole correspondingly to the gap, and the pressure ink invades into the main hole through the gap, now expanded about twice as wide, between the outer circumference of the plunger and the inner face of the main hole.

Then, if even a very small fraction of the cut portion of the plunger faces the discharge port, the ink having invaded into the main hole further invades into the discharge port through the cut portion, and gradually leaks out through the ink outlet of the ink rail piped to the discharge port. The longer the idle period of the ink pumping apparatus, the greater the quantity of the ink leak.

If the idle period is relatively short, this will invite shifting of an excessive quantity of ink to the circumferential face of the ink fountain roller, disposed close to the ink outlet of the ink rail to match the ink outlet. Or if the idle period is long, the ink leaking through the ink outlet will drip into the external periphery in addition to the excess supply to the ink fountain roller.

Therefore, if the next printing is performed in this state, an excessive quantity of ink will be fed to the form plate in the initial stage of printing, printing will be done at an inappropriately high concentration of ink for some time, and many sheets will be wasted by faulty printing, inviting a corresponding increase in running cost. Moreover, it will be necessary to clear the printing press of the ink having leaked out through the ink outlet during the idle period, imposing an extra load on the staff.

SUMMARY OF THE INVENTION

An object of the present invention is to solve the problems of the prior art noted above, and to provide an ink pumping apparatus for printing press capable of preventing ink from leaking out of the ink outlet of the ink rail during an idle period of the printing press and an ink leak preventing method therefor.

The invention is intended to solve all the problems of the prior art noted above collectively by adopting the following configuration. Thus, an ink pumping apparatus for printing press according to the invention comprises a cylinder in which a main hole having an intake port for sucking ink and a discharge port for discharging ink is formed and blocked at one end, the two ports being placed in positions in the inner face of the main hole differing in phase from each other; a plunger snapped into the cylinder and having a cut portion chipped off in the radial direction from one end for a certain range in the axial direction; a stepping motor for reciprocating the plunger within the main hole of the cylinder in the axial direction while rotating it; and motor control means for controlling the rotation of the stepping motor, wherein the motor control means so controls the rotation of the stepping motor that the outer circumference of the plunger except the cut portion blocks at least the discharge port when the stepping motor is stopped.

According to the invention, there may also be provided an ink pumping apparatus for printing press wherein a plunger having a cut portion chipped off in the radial direction from one end for a certain range in the axial direction is snapped into a cylinder in which a main hole having an intake port and a discharge port placed in positions differing in phase from each other and blocked at one end is formed; the plunger is driven by a stepping motor to reciprocate within the main hole in the axial direction while being rotated; in a certain phase of rotation, the outer circumference of the plunger except the cut portion blocks both the intake port and the discharge port, and in another phase of rotation, either the intake port or the discharge port is blocked and, when the discharge port is blocked, ink is sucked or when the intake port is blocked ink is discharged, comprising: detecting means for detecting a predetermined phase of rotation of the plunger; and motor control means which is disposed in linkage with said detecting means, with said stepping motor, and with pump operating means for supplying a starting instruction to start the rotation of said stepping motor or a stopping instruction to stop the rotation of the stepping motor, and controls the rotation of the stepping motor, wherein the motor control means keeps track of the phase of rotation of the plunger on the basis of the number of pulses provided to the stepping motor with the predetermined phase of rotation of the plunger detected by the detecting means being referenced as the origin and if, at the time of receiving a stopping instruction from the pump operating means, the phase of rotation of the plunger is in a phase of rotation where the outer circumference of the plunger except the cut portion blocks the discharge port, the stepping motor is stopped immediately or, if in a phase of rotation where the outer circumference of the plunger except the cut portion does not block the discharge port, the stepping motor is stopped after the plunger is allowed to rotate until it comes to the phase of rotation where the outer circumference of the plunger except the cut portion blocks the discharge port.

According to the invention, there may also be provided an ink pumping apparatus for printing press wherein the detecting means detects the presence of the outer circumference of the plunger except the cut portion in the phase of rotation where it blocks the discharge port; and the motor control means stops the stepping motor when the AND condition of reception of the detection signal from the detecting means and reception of the stopping instruction from the pump operating means is satisfied.

Also according to the invention, there may be provided an ink pumping apparatus for printing press wherein the motor control means, when it has received the stopping instruction from the pump operating means, if the plunger is in a phase of rotation where the outer circumference of the plunger except the cut portion does not block the discharge port, switches to a predetermined speed of rotation and allows the stepping motor to continue to rotate.

According to the invention, there may also be provided a method of preventing ink from leaking through a discharge hole in an ink pumping apparatus for printing press comprising a cylinder in which a main hole having an intake port for sucking ink and the discharge port for discharging ink is formed and blocked at one end, the two ports being placed in positions in the inner face of the main hole differing in phase from each other; a plunger snapped into the cylinder and having a cut portion chipped off in the radial direction from one end for a certain range in the axial direction; a stepping motor for reciprocating the plunger within the main hole of the cylinder in the axial direction while rotating it; and motor control means for controlling the rotation of the stepping motor, having a step of preventing ink from leaking through the discharge hole by so controlling, when the motor control means has stopped the stepping motor, the rotation of the stepping motor as to cause the outer circumference of the plunger except the cut portion to block at least the discharge port.

The following advantages can be achieved by the present invention. Namely according to the invention, every time the stepping motor is stopped, the plunger driven by the stepping motor is stopped in the phase of rotation where the outer circumference of the plunger except said cut portion blocks at least the discharge port, and the pressure of ink supplied from the intake port under pressure is utilized to prevent ink from leaking through the discharge port by tightly blocking the discharge port. As a result, no ink leaks through the ink outlet of the ink rail while the printing press is at halt, and neither an excessive quantity of ink is transferred to the ink foundation roller nor dripping of ink to the exterior around occurs.

Therefore, no excessive ink is supplied to the form plate during the initial phase of printing operation, eliminating abnormal printing with excessive density and achieving normal printing interest. The waste of many misprinted sheets is prevented, contributing to a reduction in running cost. No ink leaks from the ink inlet, the smear of the exterior around avoided, cleaning work facilitated, and no extra workload imposed on the staff.

DETAILED DESCRIPTION OF THE PREFERRED EMBODIMENTS

Figure 1:
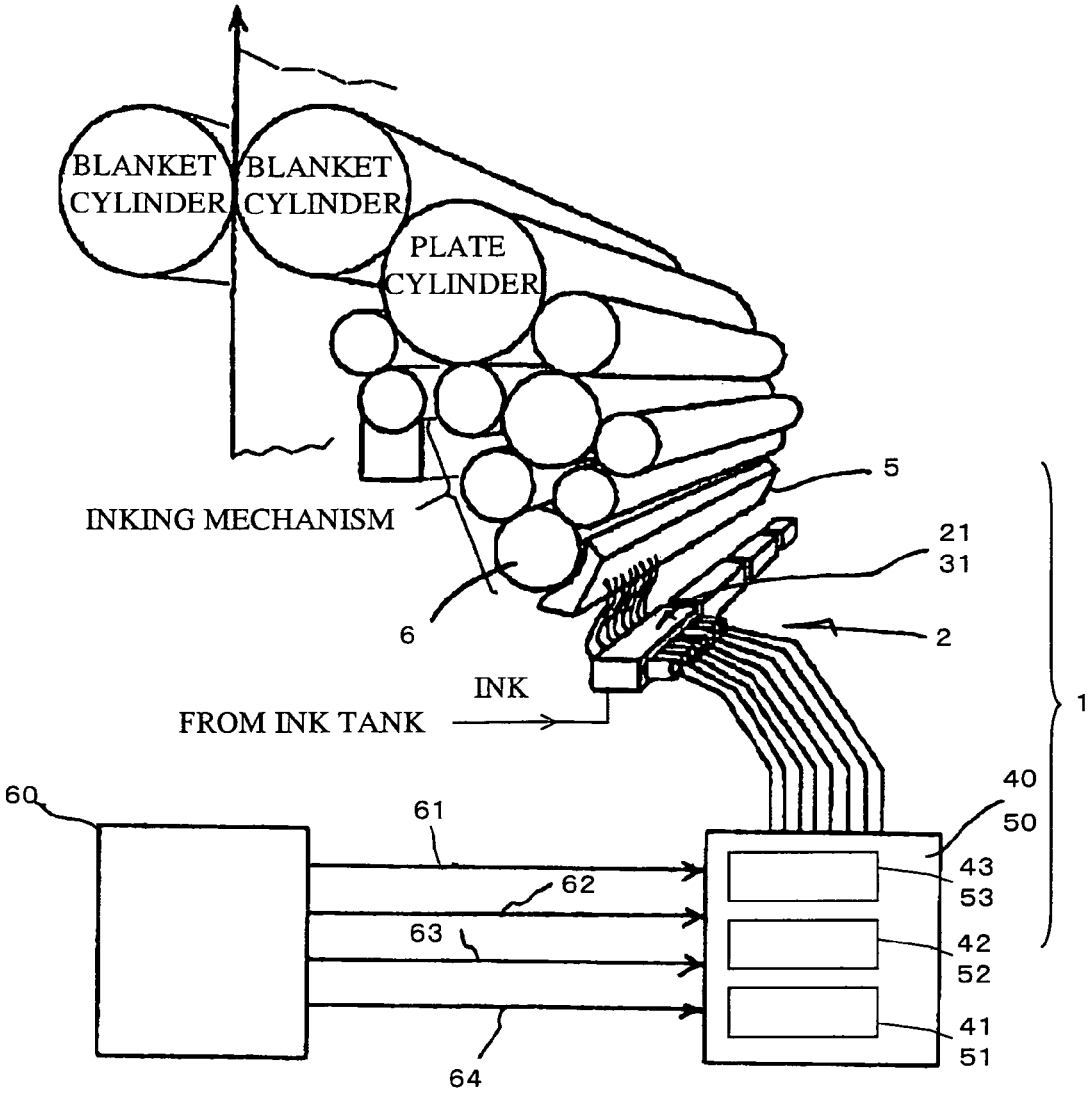
FIG. 1 shows the configuration of an ink pumping apparatus for printing press.
Figure 6:
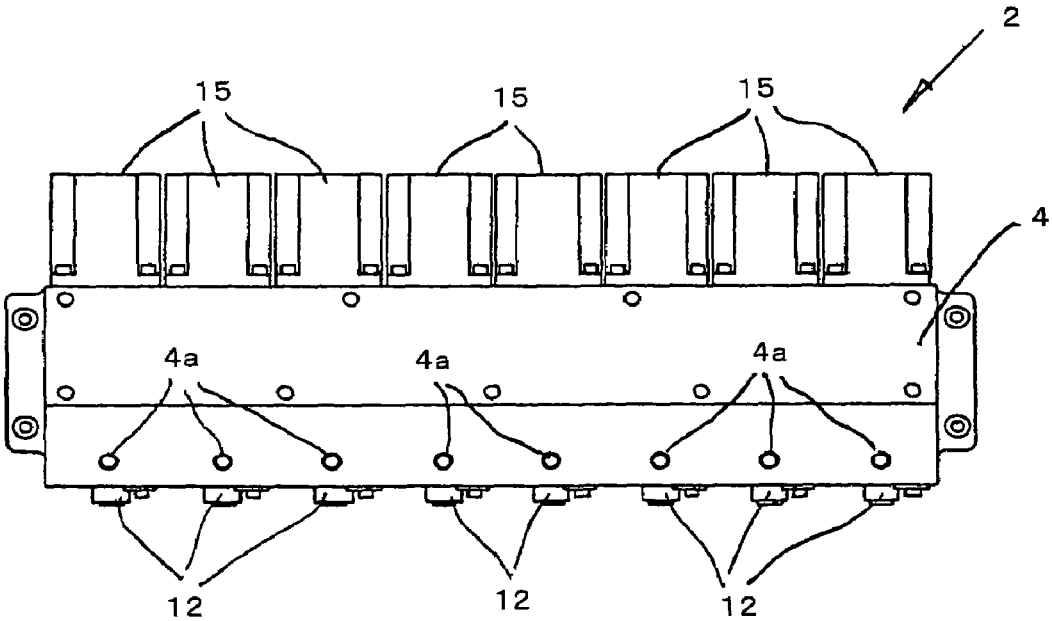
FIG. 6 shows a plan of the pump unit of the ink pumping apparatus for printing press.

Next, the ink pumping apparatus, which is the first embodiment of the present invention, will be described below with reference to drawings. An ink pumping apparatus for printing press (ink pumping apparatus) 1 is configured of an ink pump 10 constituting a pump unit 2, detecting means 21 and motor drive control means (hereinafter referred to as motor control section) 40 as shown in FIG. 1, FIG. 4 and FIG. 6.

Figure 3:
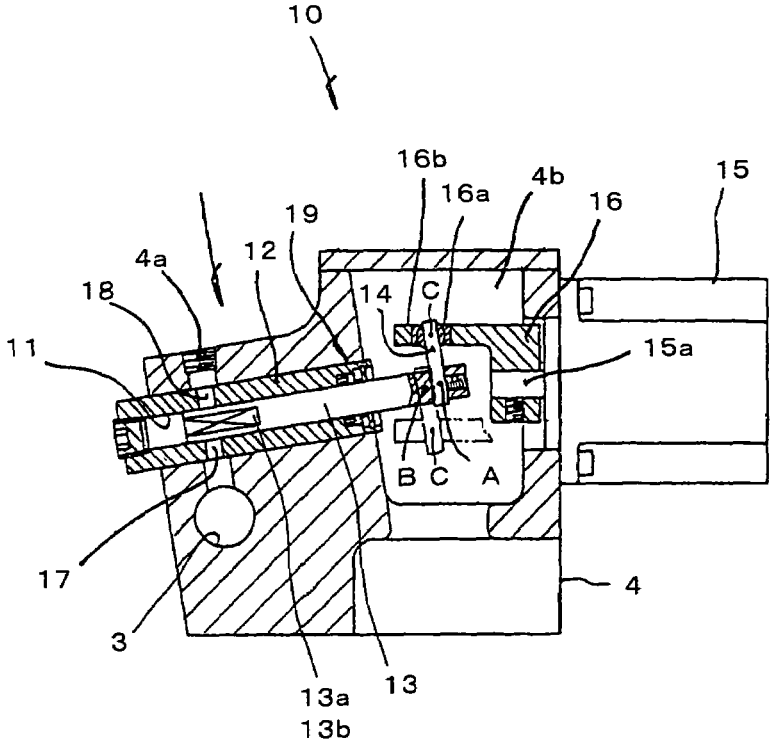
FIG. 3 shows a section of a pump unit of the ink pumping apparatus for printing press.
Figure 4:
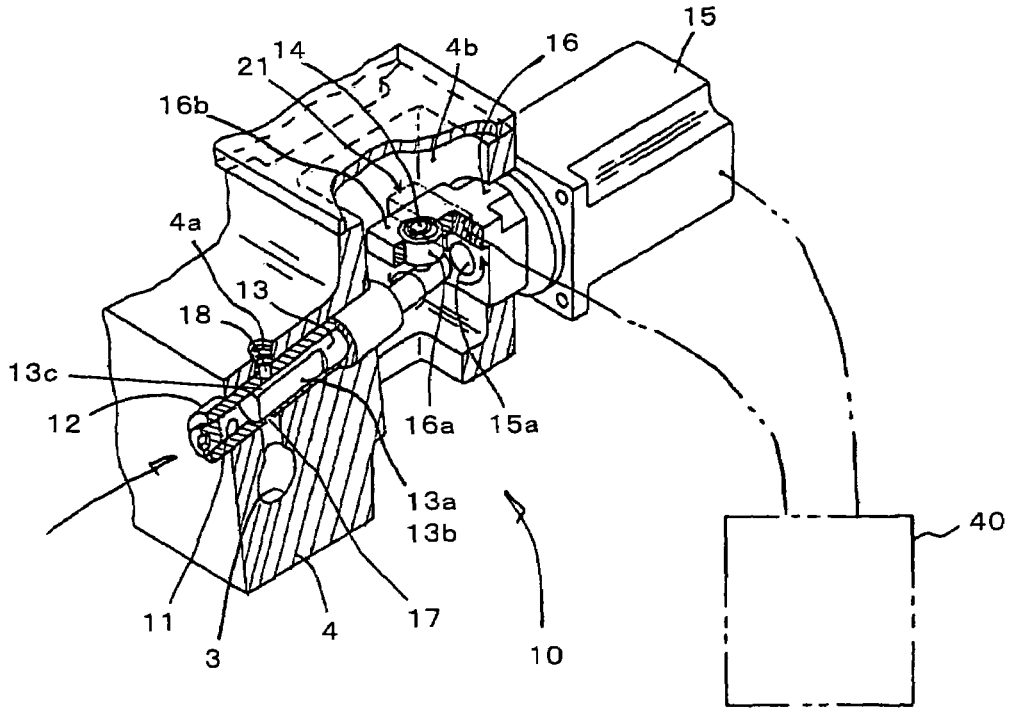
FIG. 4 shows a partial perspective view of an ink pump, which is a first embodiment of the present invention.

The ink pump 10, as shown in FIG. 3 and FIG. 4, is composed of a cylinder 12 having a main hole 11 whose one end is blocked, a plunger 13 which is snapped into the main hole 11, turns within the main hole 11 and can shift in the axial direction, a stepping motor 15 having an output shaft 15*a* fitted to be not in parallel to the plunger 13, and a base 4 to which the cylinder 12 and the stepping motor 15 are to be fitted.

The cylinder 12 is fitted, with its blocked end directed slightly downward, to the base 4. In the illustrated mode of implementing the invention, the cylinder 12 has an intake port 17 and a discharge port 18 as ink passages in positions in the inner face of the main hole 11 with their phases differing vertically by about 180 degrees from each other. The cylinder 12 further has a sealing mechanism 19 to seal a slight gap between the inner face of the main hole 11 on the opening side and the outer circumference of the plunger 13 to prevent ink from leaking out of the gap.

The plunger 13 has a cut portion 13*a* on one end side, chipped off in the radial direction from the end over a certain range in the axial direction. It has on its other end side a pin 14 so disposed as to protrude in a direction at a right angle to the shaft center and to have the protruding direction parallel to the face of the cut portion 13*a*. The plunger 13 is snapped, with its cut portion 13*a* ahead, into the main hole 11 to be rotatable and capable of reciprocating in the axial direction within the main hole 11.

In a certain phase of rotation, the outer circumference 13*c* of the plunger 13 except the cut portion 13*a* can block both the intake port 17 and the discharge port 18, and in another phase of rotation, the outer circumference 13*c* can block either the intake port 17 or the discharge port 18. In still another phase of rotation, ink can be sucked when the discharge port 18 is blocked, and ink can be discharged when the intake port 17 is blocked. Incidentally, reference numeral 13*b* denotes a cut surface.

The stepping motor 15 is disposed on the base 4, and the shaft center of the output shaft 15*a* is inclined at an appropriate angle to the shaft center of the plunger 13. The extensions of the two shaft centers cross each other. The output shaft 15*a* of the stepping motor 15 fitted to a side of the base 4 is protruded into a void 4*b* disposed on the opening side of the main hole 11 of the cylinder 12, and there is fitted an arm 16 having a tip protruding toward the opening side of the main hole 11 of the cylinder 12 in parallel to the shaft center of the output shaft 15*a*. The tip of the arm 16 fixed to the output shaft 15*a* is linked to the pin 14 via a spherical bearing 16*a* disposed at this tip.

Therefore, when the stepping motor 15 turns and the arm 16 turns, the pin 14 is caused to turn together with the arm 16 by the action of the spherical bearing 16*a* while bearing the angle of crossing the arm 16 to transmit to the plunger 13 rotation and reciprocation in the axial direction. Thus, as the shaft center of the plunger 13 and that of the output shaft 15*a* are at an appropriate angle of inclination to each other and the pin 14 is linked at a right angle to the shaft centers of both, every time the arm 16 makes a full turn, the center C of the spherical bearing 16*a* at the tip of the arm 16, centering on the shaft center of the output shaft 15*a*, makes a full turn around the plunger 13 in a prescribed radius. It is given a displacement of reciprocating one round between the positions of the intersection between a straight line descending from the center C of the spherical bearing 16*a* at a right angle to the shaft center of the plunger 13 and the shaft center of the plunger 13, namely between point A and point B in FIG. 3.

The stepping motor 15 is driven in response to driving information, to be described afterwards, received from the motor control section 40, and turns with a pulse of a pulse value P appropriately set per turn.

In this embodiment of the invention, eight ink pumps 10 are disposed on the base 4 to constitute the pump unit 2 as shown in FIG. 6. The intake port 17 for ink is piped to an ink tank (not shown) via an ink feed passage 3 disposed on the base 4, and pressurized ink is supplied from the ink tank into the ink feed passage 3. On the other hand, the discharge ports 18 through which ink is discharged from the individual ink pumps 10 communicate independently of one another with the connection holes 4*a* of the base 4, and individually connected by piping from here to an ink rail 5. Ink discharged from the individual ink pumps 10 is discharged through ink outlets (not shown) of the ink rail 5 and supplied to the circumferential face of an ink fountain roller 6 disposed close to ink outlet (see FIG. 1).

The detecting means 21, which is a proximity switch for instance, is disposed above the void 4*b* of the base 4 in the embodiment shown in FIG. 3 and FIG. 4 so that the plungers 13 driven by the stepping motors 15 can detect the phase of rotation in which the suction process is substantially completed. This detecting means (proximity switch) 21 is so disposed as to detect a detection object 16*b* at the tip of the arm 16 where the spherical bearing 16*a* is disposed every time the arm 16 linked to the plunger 13 completes a full turn and to issue a detection signal 25 on every such occasion (see FIG. 9).

In this embodiment of the invention, the plunger 13 and the stepping motor 15, directly linked by way of the pin 14 and the arm 16, are configured to rotate on a one-to-one basis. Therefore, the detecting means 21 so operates as to repeat ON/OFF actions during each turn of the stepping motor 15 and to transmit the detection signal 25 to the motor control section 40.

Figure 9:
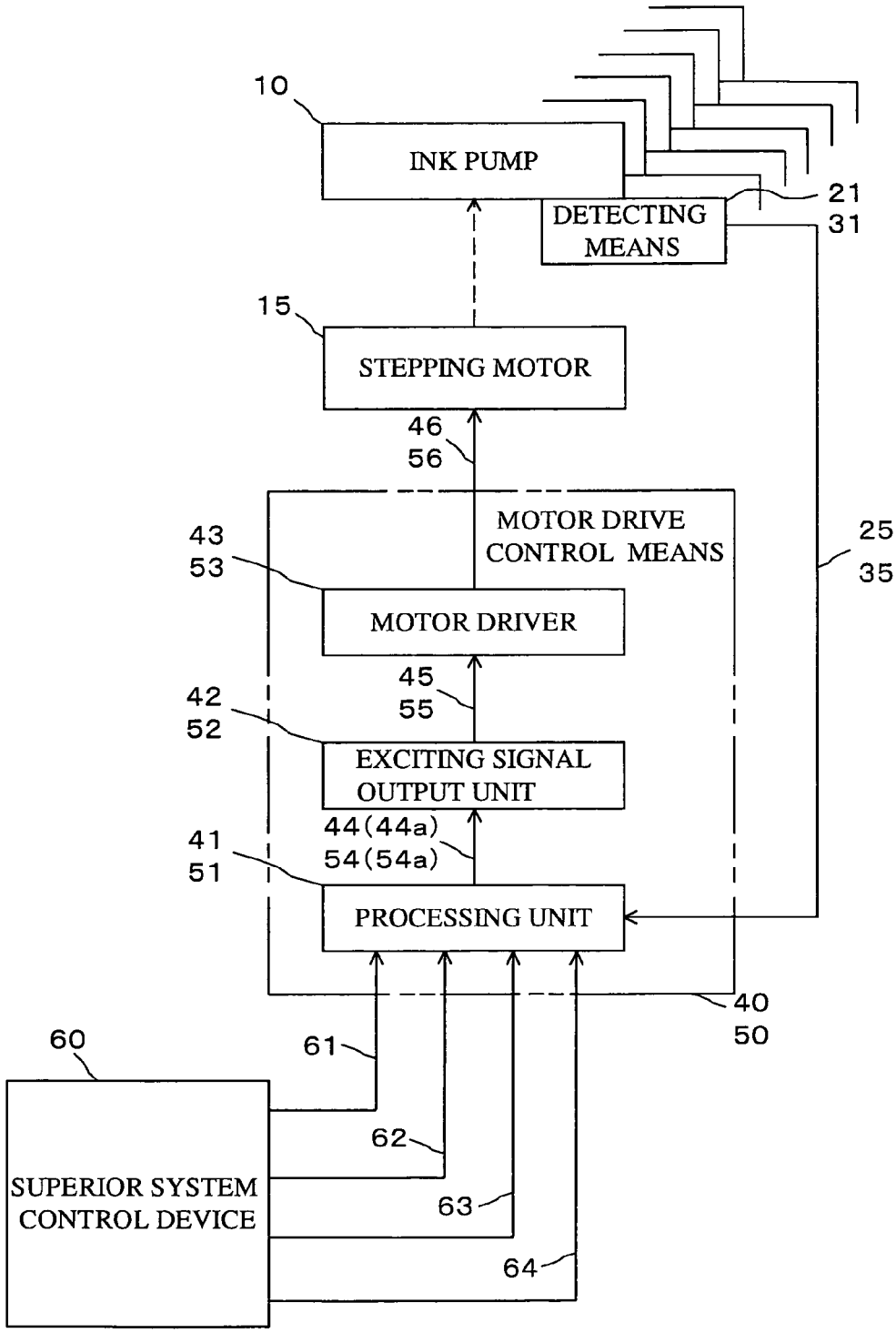
FIG. 9 shows the configuration of a motor control section.

The motor control section 40 driving the stepping motors 15 is composed of a processing unit 41, an exciting signal output unit 42 and a motor driver 43 as shown in FIG. 1 and FIG. 9. The configuration is such that the operations of the stepping motor 15 of each ink pump 10 incorporated into the pump unit 2 are controlled in accordance with various signals, an operating instruction and a stopping instruction, to be described afterwards entered from a superior system control device 60, which is pump operating means, and the detection signal 25 entered from the detecting means 21.

Signals entered into the processing unit 41 include: from the superior system control device 60, an ink feed correction coefficient signal 64 based on data of the image area ratio given correspondingly to the image area ratio of the printed face of the object of ink supply (hereinafter referred to as the column) of the ink fountain roller 6 appropriately divided in the axial direction and on ink data given according to the type of ink used; also from the superior system control device 60, a printing speed signal 63 as speed information proportional to the printing speed; from the detecting means 21, the detection signal 25; and from the superior system control device 60, an operating instruction 61 or a stopping instruction 62.

The detection signal 25 is an ON signal continuous during the detection of the detection object 16*b* at the tip of the arm 16. The processing unit 41 prescribes the phase of the plunger 13 at the rise point of this detection signal 25 to be the origin to be referenced, and processes the control of the phase of rotation of the plunger 13 accordingly.

Figure 7:
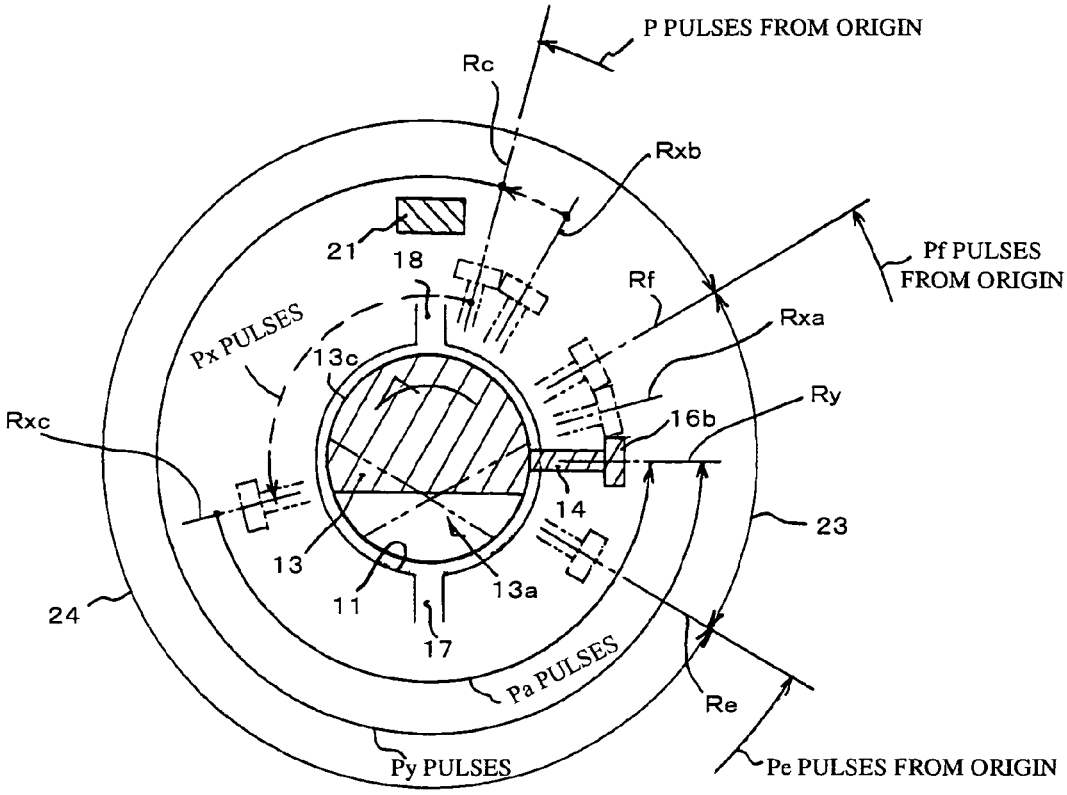
FIG. 7 shows the relationship of the stop-permissible range and the stop-impermissible range of the plunger to detecting means in the first embodiment of the invention.

Thus, referring to FIG. 7 which shows the relationship in terms of the phase of rotation of the plunger 13 in a sectional view at a right angle to the shaft center of the plunger 13, the phase of rotation of the plunger 13 at the time of the first detection of the detection object 16*b* by the detecting means 21 is set to be the origin Rc. Then, when the operating instruction 61 to start printing is received for instance, in order to carry out appropriate ink feeding on the basis of the ink feed correction coefficient signal 64 and the printing speed signal 63 as shown in FIG. 9, a motor driving pulse (hereinafter referred to simply as the driving pulse) of a frequency F to turn the stepping motors 15 at an appropriate speed is supplied as driving information 44 for turning the stepping motors 15 at the appropriate speed.

Or when the stopping instruction 62 to end printing is received, in order to stop the turning of the stepping motors 15, the timing at which to stop the stepping motors 15 is computed on the basis of the detection signal 25 transmitted from the detecting means 21 and the stopping instruction 62. As driving information 44*a* to stop the stepping motors 15 at the timing so computed, a driving pulse W to turn the stepping motors 15 only as much as to displace the plungers 13 to the appropriate stopping position is to be supplied. This processing will be described afterwards with reference to FIG. 10.

The exciting signal output unit 42, as shown in FIG. 9, supplies an exciting pulse signal 45 for phase-excitation of the stepping motors 15 on the basis of the driving information 44 and 44*a* entered from the processing unit 41, i.e. correspondingly to the driving pulse W.

The exciting pulse signal 45 for phase-excitation of the stepping motors 15 is entered from the exciting signal output unit 42 into the motor driver 43, which supplies motor driving amplified power signal 46 to the coil of each phase of the stepping motors 15 to drive the stepping motors 15 on the basis of the exciting pulse signal 45.

Figure 5:
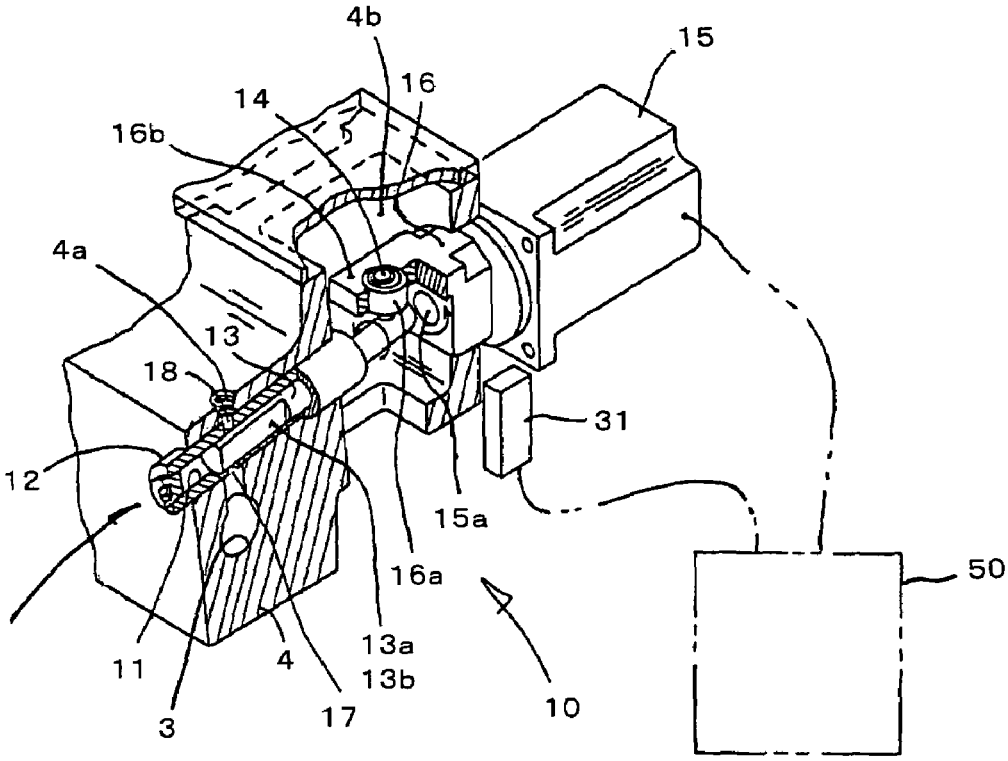
FIG. 5 shows a partial perspective view of an ink pump, which is a second embodiment of the invention.

Next will be described the ink pumping apparatus for printing press, which is the second embodiment of the invention, with reference to drawings. The ink pumping apparatus 1, as shown in FIG. 1, FIG. 5 and FIG. 6, is configured of the ink pumps 10, detecting means 31, motor drive control means (hereinafter referred to as the motor control section) 50 constituting the pump unit 2.

As the ink pumps 10 have the same configuration as their counterparts in the foregoing first embodiment of the invention, their description will be dispensed with. The detecting means 31 is, for instance a proximity switch for detecting the phase of rotation of the plungers 13 driven by the stepping motors 15 and, in the embodiment illustrated in FIG. 5, is disposed along side the plunger 13 in the void 4*b* of the base 4. This detecting means (proximity switch) 31 detects the detection object 16*b* at the tip of the arm 16 where the spherical bearing 16*a* is disposed every time the arm 16 linked to the plunger 13 completes a full turn and to issue a detection signal 35 on every such occasion (see FIG. 9).

Figure 2A:
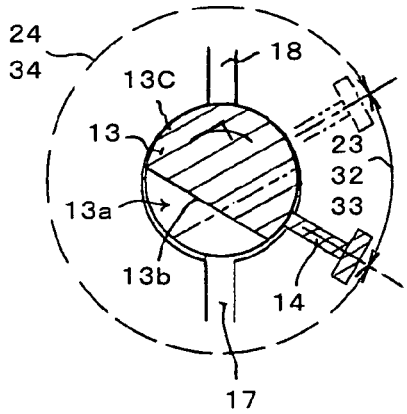
FIG. 2A through FIG. 2C show how the discharge port is blocked according to the phase of rotation of the plunger.
Figure 2B:
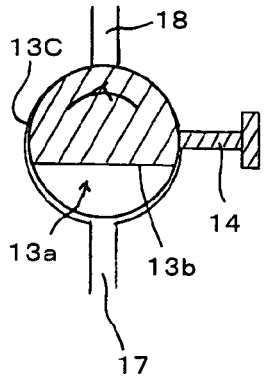
Figure 2C:
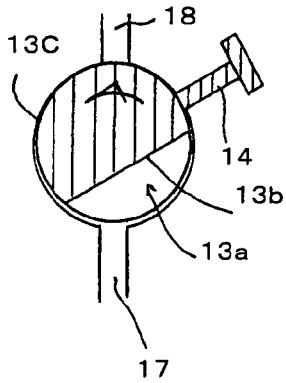

In this second embodiment of the invention, as in the first embodiment, the plunger 13 and the stepping motor 15, directly linked by way of the pin 14 and the arm 16, are configured to rotate on a one-to-one basis. In other words, a detection range 32 (see FIG. 8) in which the detection object 16*b* is detected by the detecting means 31 is so set that, as shown in FIG. 2A through FIG. 2C, the outer circumferences 13*c* of the plungers 13, which rotate driven by the stepping motors 15, except the cut portions 13*a* take on a phase of rotation to block at least the ink discharge ports 18.

Then, the detecting means 31 so operates as to repeat ON/OFF actions during each turn of the stepping motors 15 and to transmit the detection signal 35 to motor drive control means (the motor control section) 50 (see FIG. 9).

The motor control section 50, as shown in FIG. 9, having a similar form to its counter part in the foregoing first embodiment of the invention, is configured of a processing unit 51, an exciting signal output unit 52 and a motor driver 53.

Into the processing unit 51, as shown in FIG. 9, the ink feed correction coefficient signal 64, the printing speed signal 63, the operating instruction 61 or the stopping instruction 62 and the detection signal 35 are entered from the superior system control device 60 as in the foregoing first embodiment of the invention.

The processing unit 51, as does the processing unit 41 in the foregoing first embodiment of the invention, supplies driving information 54 for continuously turning the stepping motors 15 when it has received the operating instruction 61 or, when it has received the stopping instruction 62, supplies driving information 54*a* for stopping the stepping motor 15. The driving information 54*a* for stopping the stepping motors 15 which are turning causes the stepping motors 15 to stop when AND condition with the detection signal 35 transmitted from the detecting means 31 is satisfied.

The exciting signal output unit 52, as does the exciting signal output unit 42 in the foregoing first embodiment of the invention, supplies an exciting pulse signal 55 for phase-excitation of the stepping motors 15 on the basis of the driving information 54 and 54*a* entered from the processing unit 51.

The motor driver 53, like the motor driver 43 in the foregoing first embodiment of the invention, supplies a motor driving amplified power signal 56 to drive the stepping motors 15 on the basis of the exciting pulse signal 55 entered from the exciting signal output unit 52.

Next, the actions in the ink pumping apparatus for printing press according to the invention in this mode will be described with reference to drawings. In each of the ink pumps 10 of the ink pumping apparatus 1 so far described, when the stepping motor 15 turns counterclockwise as viewed from the plunger 13 side (from left to right in FIG. 4), the arm 16 fixed to the output shaft 15*a* turns in the same direction as shown in FIG. 4 and region A through region F shown in FIG. 12.

Since the arm 16 is linked to the plunger 13 by way of the spherical bearing 16*a* and the pin 14 and the shaft center of the output shaft 15*a* and that of the plunger 13 cross each other at an appropriate angle of inclination, while the arm 16 in the position shown in FIG. 4 achieves its first 180 degrees of a turn, the plunger 13 having blocked the intake port 17 and the discharge port 18 with its outer circumference 13*c* except the cut portion 13*a* (see region A of FIG. 12) shifts from point A in FIG. 3, where the cut portion 13*a* communicates with the discharge port 18 and forces its way into the main hole 11 while keeping the blockade of the intake port 17 and turning counterclockwise, to point B. It thereby forces out ink in the main hole 11 through the discharge port 18 (see region B through region C shown in FIG. 12), and at the final stage the plunger 13 again blocks the intake port 17 and the discharge port 18 (see region D of FIG. 12).

Figure 12:
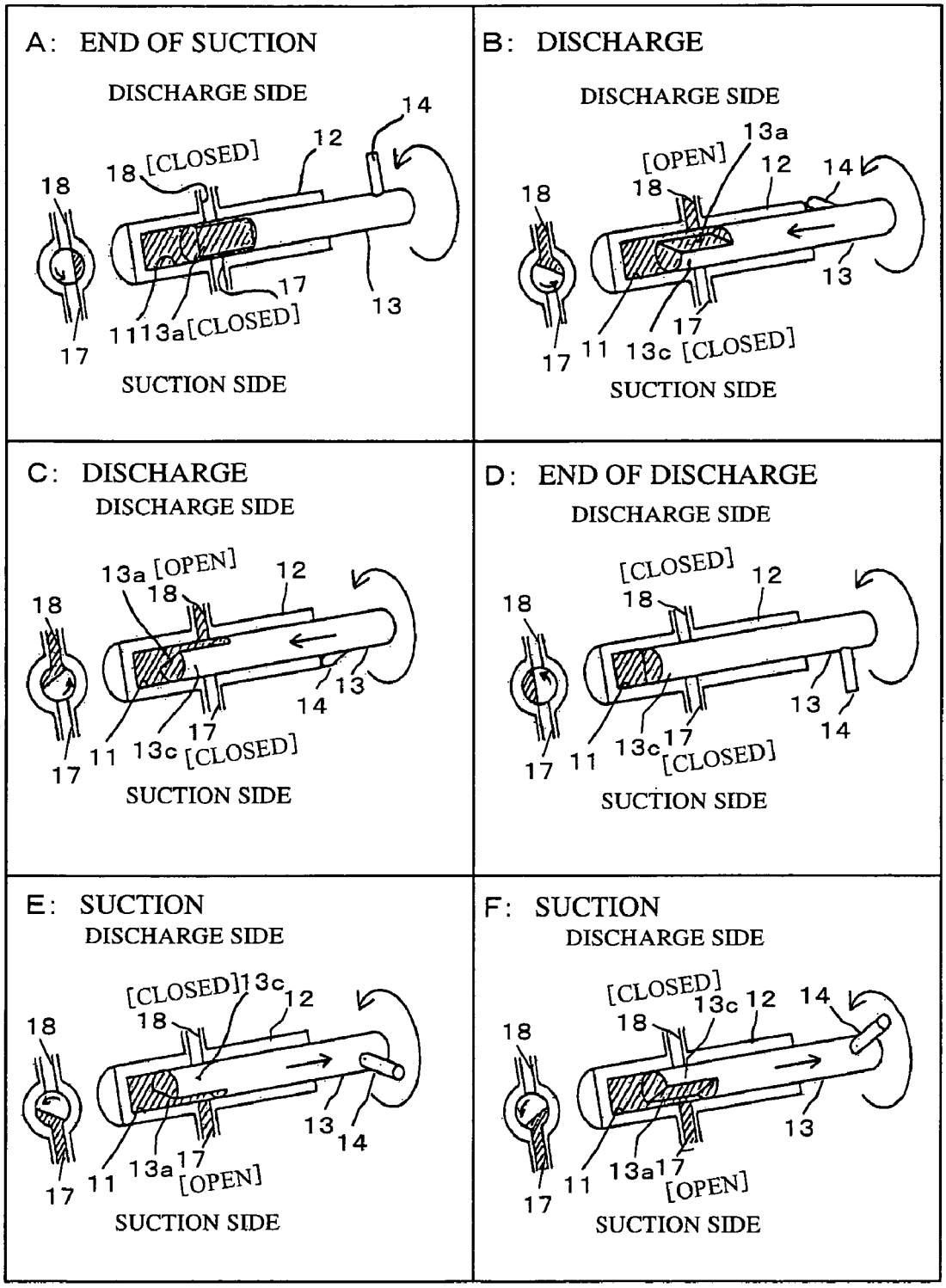
FIG. 12 shows the form of operation of the plunger moving in the main hole.

Then in the process of the arm 16 achieving its second 180 degrees of a turn, while the plunger 13 (see region D of FIG. 12) turns counterclockwise while keeping the blockade of the discharge port 18, the cut portion 13*a* communicates with the intake port 17, shifts from point B where it comes out of the main hole 11 to point A, and sucks from the intake port 17 the ink supplied under pressure from the ink tank to the ink feed passage 3 (see region E through region F shown in FIG. 12). At the final stage, the plunger 13 again blocks the intake port 17 and discharge port 18 with the outer circumference 13*c* (see region A of FIG. 12).

This sequence of operations is similarly carried out in every ink pump 10 of each pump unit 2, and the individual stepping motors 15 turn at different speeds depending on such conditions as the image area ratio and printing speed. Upon completion or printing, when the stopping instruction 62 transmitted from the superior system control device 60 is received, the motor control section 40 so operates as to stop, in any of the ink pumps 10, the plunger 13 in a phase of rotation to block at least the ink discharge ports 18 with the outer circumference 13*c* of the plunger 13 except the cut portion 13*a*.

Since this operation of the motor control section 40 individually and similarly works on every ink pump 10, the following description will refer to only one ink pump 10, but description of all other ink pumps 10, 10 . . . will be dispensed with.

Figure 10:
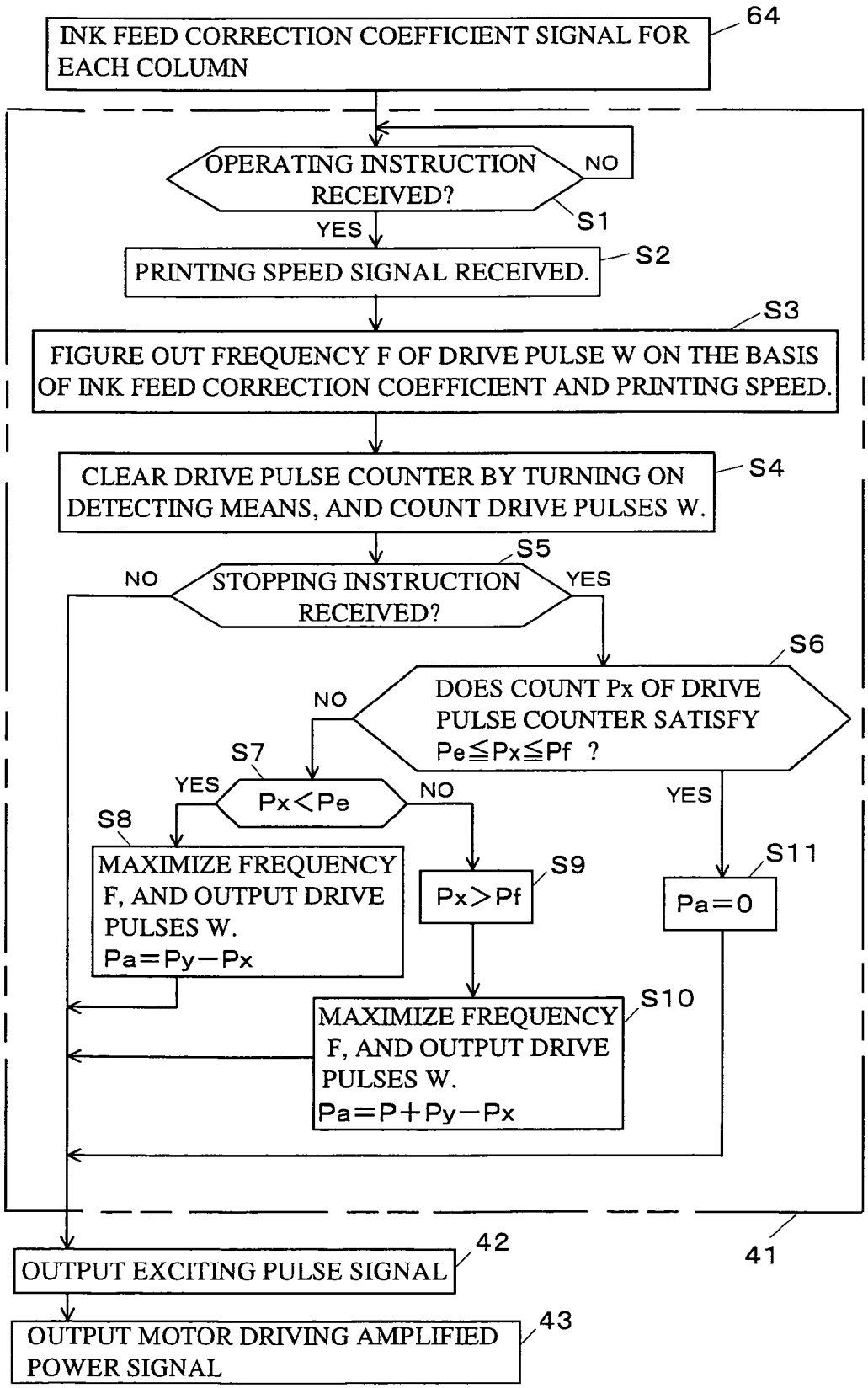
FIG. 10 is a flow chart of control by the motor control section in the processing unit pertaining to the first embodiment of the invention.

In the first embodiment of the invention, the ink feed correction coefficient signal 64 supplied from the superior system control device 60 is received column by column in the processing unit 41 (step S1) as shown in FIG. 9 and FIG. 10. Then the operating instruction 61 is received, and so is the printing speed signal 63 (step S2) to figure out the printing speed V. The frequency F of the driving pulse W is figured out on the basis of the ink feed correction coefficient signal 64 and the printing speed V (step S3).

Then, the driving pulse W of the frequency F so figured out is supplied as the driving information 44. Every time the detecting means 21 is turned ON and the detection signal 25 is supplied, while a driving pulse counter built into the processing unit 41 is cleared at its rise, the driving pulses W are counted with this driving pulse counter (step S4).

In the exciting signal output unit 42, when the driving information 44 is received, the exciting pulse signal 45 which subjects the stepping motor 15 to phase excitation is supplied to the motor driver 43 on the basis of the received driving information 44, i.e. correspondingly to the driving pulse W. The motor driver 43, on the basis of the entered exciting pulse signal 45, supplies the motor driving amplified power signal 46 to be let flow in the coil of each phase in the stepping motor 15. The stepping motor 15 is driven by the entered motor driving amplified power signal 46.

Every time the stepping motor 15 completes a full turn, the arm 16 makes one turn, and the detecting means 21, capturing the detection object 16*b* of the turning arm 16, supplies the detection signal 25, which is entered into the processing unit 41. The stepping motor 15 performs normal operation tuned to the printing speed V until the processing unit 41 receives the stopping instruction 62 from the superior system control device 60 (step S5).

On the other hand, when the stopping instruction 62 is received from the superior system control device 60 (step S5), the processing unit 41 stops the plunger 13 in such a phase that its outer circumference 13*c* except the cut portion 13*a* blocks the discharge port 18 of the cylinder 12. Thus, by stopping the plunger 13 in such a phase, the ink having invaded from the intake port 17 into the main hole 11 of the cylinder 12 and pressured pushes and displaces the plunger 13, and presses the plunger 13 against the inner circumferential face of the main hole 11 into which the discharge port 18 opens.

The pressured ink is thereby prevented from invading into the discharge port 18. In more detail, the rotation phase range of the plunger 13 in which its outer circumference 13*c* blocks the discharge port 18 is prescribed to be the stop-permissible range 23 of the plunger 13, and the rotation phase range of the plunger 13 in which at least part of the cut portion 13*a* faces the discharge port 18 is prescribed to be the stop-impermissible range 24 of the plunger 13. In order to stop the plunger 13 in an appropriate phase of rotation, the processing unit 41 stops the stepping motor 15 at an appropriate timing on the basis of the reception timing of the stopping instruction 62 and that of the detection signal 25 supplied by the detecting means 21.

In more specific terms, the following process takes place. Thus in the processing unit 41, when the detecting means 21 turns ON and the detection signal 25 is entered into the processing unit 41 as shown in FIG. 7, FIG. 9 and FIG. 10, the driving pulse counter is cleared at the rise of the detection signal 25, and the driving pulses W are newly counted (step S4 described above).

At the point of time where the driving pulse counter is cleared, namely when the detection signal 25 has formed its leading edge, the point where the detection object 16*b* is to be detected is prescribed to be the origin Rc of rotational displacement; the position of rotational displacement of the detection point where the phase of rotation of the plunger 13 is brought into the stop-permissible range 23 by the rotational displacement is prescribed to be the upstream side starting point Re; the position of rotational displacement of the detection point immediately before the phase of rotation of the plunger 13 is driven out of the stop-permissible range 23 by the rotational displacement is prescribed to be the downstream side terminal point Rf; and any predetermined fixed point between the upstream side starting point Re and the downstream side starting point Rf is prescribed to be the fixed point Ry. Where the number of the driving pulses W required to cause the stepping motor 15 to turn to subject the detection point to rotational displacement from the origin Rc to the upstream side starting point Re is Pe, the number of the driving pulses W required to cause the stepping motor 15 to turn to subject the detection point to rotational displacement from the origin Rc to the downstream side terminal point Rf is Pf, and the number of the driving pulses W required to cause the stepping motor 15 to turn to subject the detection point to rotational displacement from the origin Rc to the fixed point Ry is Py, the processing unit 41 recognizes that the phase of rotation of the plunger 13 is in the stop-permissible range 23 when the count Px of the driving pulse counter satisfies $Pe \leqq Px \leqq Pf$ (step S6 in FIG. 10), or that the phase of rotation of the plunger 13 is in the stop-impermissible range 24 when the count Px satisfies $Px<Pe$ or $Px>Pf$ (step S7 and step S9).

When the count Px of the driving pulse counter at the time of receiving the stopping instruction 62 is $Px<Pe$ or $Px>Pf$ (namely, the phase of rotation of the plunger 13 at the time of receiving the stopping instruction 62 is Rxc or Rxb), the processing unit 41 alters the frequency F of the driving pulse W to the maximum frequency the processing unit 41 can set, at the same time computes from the count Px of the driving pulses W at the time the stopping instruction 62 has been received and the number Py of the driving pulses W regarding the fixed point Ry the corrected number of driving pulses Pa for stopping the plunger 13 in a state in which its phase of rotation is in the stop-permissible range 23 according to $Pa=Py-Px$ if Px is smaller than Pe (step S8) or according to $Pa=P+Py-Px$ if Px is greater than Pf (step S10), and supplies the obtained numeral Pa of driving pulses W of the maximum frequency as the driving information 44. P here is the required number of driving pulses W for turning the detection point by a full turn from the origin Rc.

When the count Px of the driving pulse counter at the time of receiving the stopping instruction 62 is $Pe \leqq Px \leqq Pf$ (namely, the phase of rotation of the plunger 13 at the time of receiving the stopping instruction 62 is Rxa), the processing unit 41 recognizes from the count Px of the driving pulses W that it is within the stop-permissible range 23, computes the corrected number of driving pulses $Pa=0$ for immediately stopping the plunger 13 in that phase (step S11), and stops supplying the driving pulses W as the driving information 44*a*.

In both cases, the driving pulses W as many as the corrected number of driving pulses Pa are entered into the exciting signal output unit 42. The exciting signal output unit 42 supplies the motor driver 43 with the exciting pulse signal 45 which matches the driving pulses W and is intended for subjecting the stepping motor 15 to phase excitation. The motor driver 43 amplifies power on the basis of the entered exciting pulse signal 45 and drives the stepping motor 15.

Therefore, the phase of rotation in which the plunger 13 driven by the stepping motor 15 stops is the phase of rotation in the stop-permissible range 23 of the phase matching a state in which the detection point has reached the predetermined fixed point Ry if the plunger 13 is in a phase of rotation in the stop-impermissible range 24 at the time of receiving the stopping instruction 62, or the phase at the time receiving the stopping instruction 62 if the plunger 13 is in a phase of rotation in the stop-permissible range 23 at the time of receiving the stopping instruction 62.

As shown in FIG. 2A through FIG. 2C, in the phase of rotation of the plunger 13 having stopped in the stop-permissible range 23, the outer circumference 13*c* except the cut portion 13*a* blocks the discharge port 18. The blocking of the discharge port 18 by the outer circumference 13*c* causes the pressure of ink supplied from the ink tank to the intake port 17 under pressure to displace the outer circumference 13*c* toward the discharge port 18, and tightly blocks the discharge port 18 to prevent ink leakage as described above.

Next, the actions of the second embodiment of the invention will be described. The control of the stepping motor 15 by the motor control section 50 in this second embodiment in a state in the operating instruction 61 has been received (step S21 through step S24 in FIG. 11) is the same as in the first embodiment, and accordingly the description will be dispensed with.

In the second embodiment, as shown in FIG. 5, FIG. 8 and FIGS. 12A through 12F, the detecting means 31 is so disposed that, when the phase of rotation of the plunger 13 is within a stop-permissible range 33, detects the detection object 16*b* of the arm 16 and supplies the detection signal 35. Further, the motor control section 50 stops the stepping motor 15 when the detection signal 35 is received and the AND condition of the stopping instruction 62 for reception is satisfied.

Therefore, the plunger 13 operated by the stepping motor 15 within the main hole 11, as shown in FIG. 9, is disposed to stop every action in the phase of rotation for blocking at least the discharge port 18 with the outer circumference 13*c* of the plunger 13 except the cut portion 13*a* when the motor control section 50 receives the stopping instruction 62.

Figure 8:
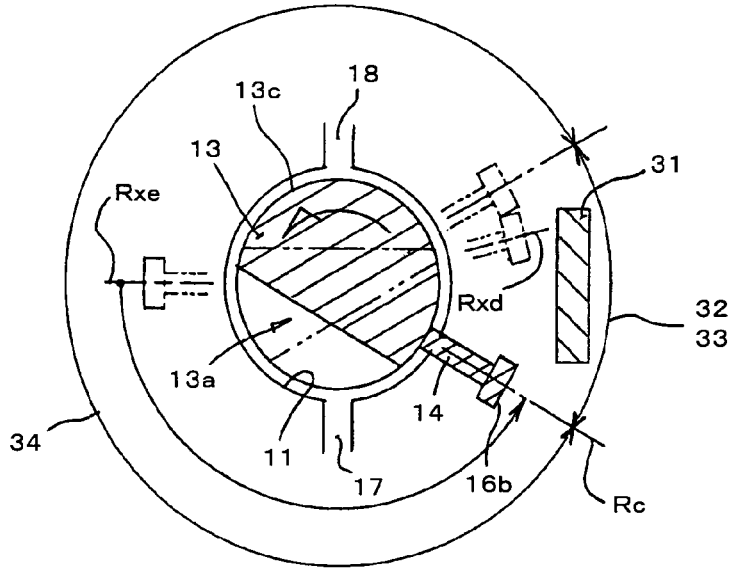
FIG. 8 shows the relationship of the stop-permissible range and the stop-impermissible range of the plunger to detecting means in the second embodiment of the invention.

Thus, at the time of receiving the stopping instruction 62 (step S25), if, for instance, the phase of rotation of the plunger 13 is Rxe within a stop-impermissible range 34 of FIG. 8 and the detecting means 31 has not detected the detection object 16*b* of the arm 16 (step S26), the processing unit 51 supplies the driving pulses W whose frequency F has been altered to the maximum frequency the processing unit 51 can set as the driving information 54 (step S28 and step S29). The driving pulses W supplied from the processing unit 51 are entered into the exciting signal output unit 52.

The exciting signal output unit 52, as shown in FIG. 9, supplies the motor driver 53 with the exciting pulse signal 55 which matches the driving pulses W and subjects the stepping motor 15 to phase excitation. The motor driver 53 amplifies power on the basis of the entered exciting pulse signal 55, and drives the stepping motor 15. Therefore, the stepping motor 15 turns at high speed. When the arm 16 is caused by this turning of the motor to reach the detection range 32 of the detecting means 31, the detecting means 31 detects the detection object 16*b* and supplies the detection signal 35.

Upon receiving this detection signal 35, as the AND condition between the stopping instruction 62 and the detection signal 35 is satisfied, the processing unit 51 computes the corrected number of driving pulses Pa=0 for immediately stopping the stepping motor 15 (step S30), and stops supplying the driving pulses W as the driving information 54*a*.

Figure 11:
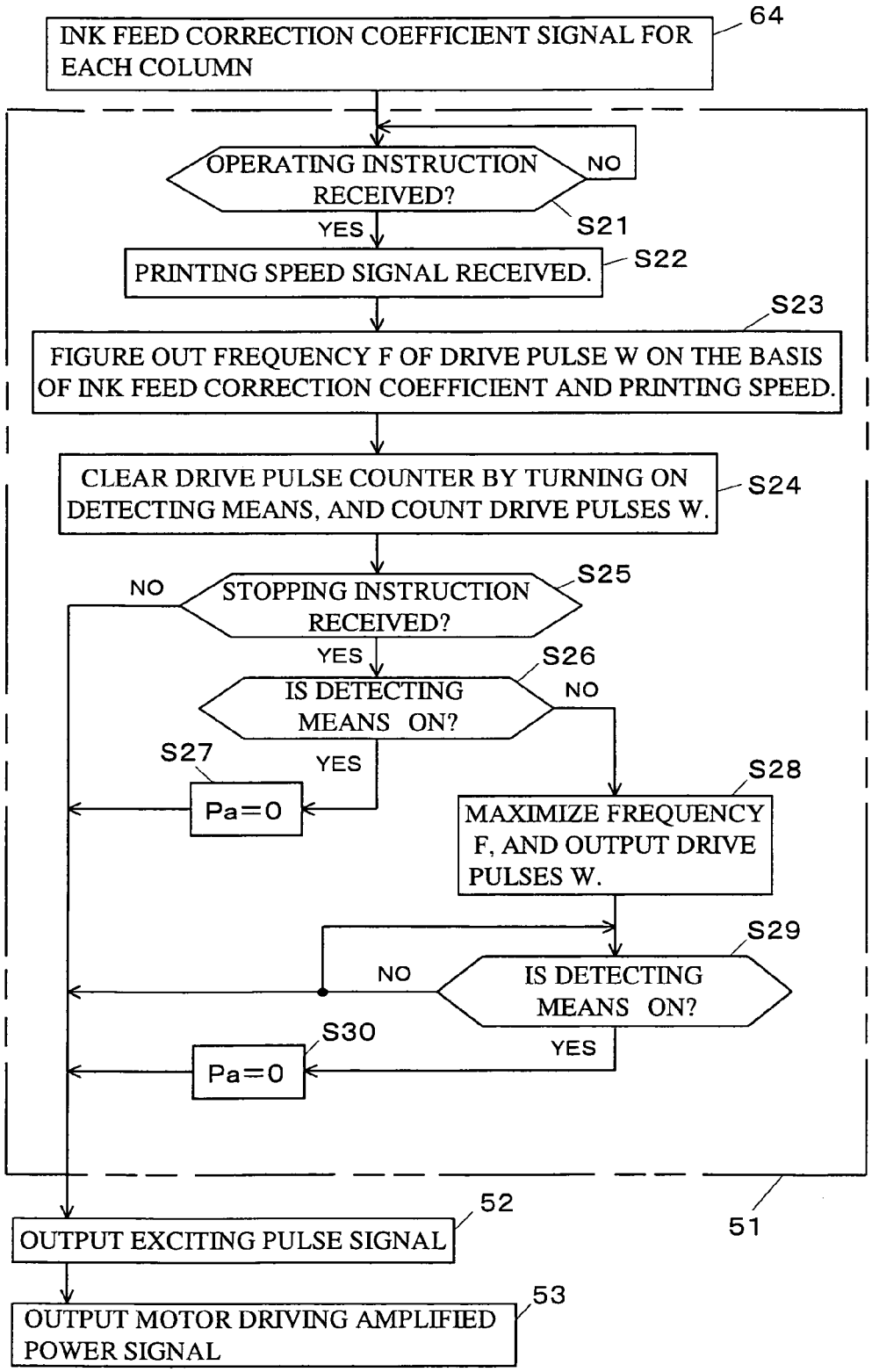
FIG. 11 is a flow chart of control by the motor control section in the processing unit pertaining to the second embodiment of the invention.

On the other hand, as shown in FIG. 8 and FIG. 11, if, for instance, the phase of rotation of the plunger 13 is Rxd in FIG. 8 and the detecting means 31 has detected the detection object 16*b* of the arm 16 at the time of receiving the stopping instruction 62, the processing unit 51, as it is in a state of receiving the detection signal 35 and the AND condition between this detection signal 35 and the stopping instruction 62 is satisfied, computes the corrected number of driving pulses Pa=0 for immediately stopping the stepping motor 15 (step S27), and stops supplying the driving pulses W as the driving information 54*a*.

Then, as shown in FIG. 2A through FIG. 2C and FIG. 8, in the phase of rotation of the plunger 13 having stopped in the stop-permissible range 33, the outer circumference 13*c* except the cut portion 13*a* blocks the discharge port 18. The blocking of the discharge port 18 by the outer circumference 13*c* causes the pressure of ink supplied from the ink tank to the intake port 17 under pressure to displace the outer circumference 13*c* toward the discharge port 18, and tightly blocks the discharge port 18 to prevent ink leakage as described above.

What is claimed is:

1. An ink pumping apparatus for a printing press that receives and discharges ink supplied under pressure, the apparatus comprising:

a cylinder defining a main hole having an intake port for sucking ink and a discharge port for discharging ink supplied from said intake port, said cylinder being closed at one end, said intake port and said discharge port being located along an inner surface of the cylinder such that said intake port and said discharge port differ in phase;

a plunger, said main hole of said cylinder receiving said plunger such that said plunger is rotatable and movable in an axial direction, said plunger having a portion chipped off in a radial direction from one end thereof to define a cut portion extending in an axial direction, said plunger having an outer circumference portion located opposite said cut portion at said one end, said outer circumference portion of said plunger blocking said intake port and said discharge port in one phase of rotation, said cut portion of said plunger not blocking said intake port or said discharge port in said one phase of rotation, said outer circumference portion blocking one of said intake port and said discharge port in another phase of rotation;

a stepping motor for reciprocating said plunger within the main hole of said cylinder in the axial direction while rotating said plunger; and a motor control means for determining a number of pulses to rotate said plunger to a phase of rotation in which said outer circumference portion blocks said discharge port and for controlling the rotation of said stepping motor based on said number of pulses such that the outer circumference portion of the plunger blocks said discharge port when said motor control means stops said stepping motor, whereby said cut portion does not block said discharge port when said stepping motor is stopped, said outer circumference portion of said plunger pressing against said inner surface of said cylinder at said discharge port when said motor control means stops said stepping motor such that said outer circumference portion seals said discharge port, whereby ink cannot leak out of said discharge port.

2. The ink pumping apparatus for printing press according to claim 1, wherein said outer circumference portion of said plunger engages said inner surface of said cylinder via pressure from the ink delivered by said intake port.

3. An ink pumping apparatus for printing press, the apparatus comprising:

a plunger having a portion chipped off in a radial direction from one end thereof to define a cut surface, said cut surface extending in an axial direction, said plunger having an outer circumference portion located opposite said cut surface;

a cylinder defining a main hole having an intake port and a discharge port, said main hole of said cylinder receiving said plunger, said intake port and said discharge port being located along an inner surface of said cylinder such that said intake port has a different phase than a phase of said discharge port, said cylinder being closed at one end;

a stepping motor for driving said plunger such that said plunger reciprocates within the main hole in the axial direction while being rotated, said outer circumference portion of the plunger blocking the intake port and the discharge port in one phase of rotation such that said cut surface does not block the intake port or the discharge port, one of said intake port and said discharge port being sealed via said outer circumference portion of said plunger in another phase of rotation, wherein ink supplied under pressure is received via said intake port when said outer circumference portion blocks said discharge port or ink supplied under pressure is discharged via said discharge port when said intake port is blocked;

a detecting means for detecting a predetermined phase of rotation of said plunger; and a motor control means associated with said detecting means, with said stepping motor, and with a pump operating means for supplying a starting instruction to start the rotation of said stepping motor or a stopping instruction to stop the rotation of said stepping motor, and for controlling the rotation of said stepping motor and for determining a number of pulses to rotate said plunger to a blocked discharge port position, said motor control means rotating said stepping motor based on said number of pulses such that said plunger rotates to said blocked discharge port position and said stepping motor stops after said motor control means receives a stopping instruction from said pump operating means, wherein said outer circumference portion of said plunger is in contact with said inner surface of said cylinder in an area of said discharge port when said plunger is in said blocked discharge port position such that said outer circumference portion of said plunger seals said discharge port when said stepping motor is stopped, whereby said outer circumference portion of said plunger prevents ink from discharging from said discharge port.

4. The ink pumping apparatus for printing press according to claim 3, wherein:

said detecting means detects the presence of the outer circumference portion of the plunger in the phase of rotation where said outer circumference portion blocks said discharge port; and said motor control means stops said stepping motor when an AND condition of reception of a detection signal from said detecting means and reception of the stopping instruction from said pump operating means is satisfied.

5. The ink pumping apparatus for printing press according to claim 3, wherein said motor control means switches to a predetermined speed of rotation and allows said stepping motor to continue to rotate if said plunger is in a phase of rotation such that said outer circumference portion does not block said discharge port when said motor control means has received said stopping instruction from said pump operating means.

6. The ink pumping apparatus for printing press according to claim 4, wherein said motor control means switches to a predetermined speed of rotation and allows said stepping motor to continue to rotate if said plunger is in a phase of rotation such that said outer circumference portion does not block said discharge port when said motor control means has received said stopping instruction from said pump operating means.

7. The ink pumping apparatus for printing press according to claim 3, wherein said outer circumference portion of said plunger engages said inner surface of said cylinder via pressure from the ink delivered through said intake port.

8. A method of preventing ink from leaking through a discharge hole in an ink pumping apparatus for a printing press, the method comprising:

providing a cylinder defining a main hole having an intake port for supplying ink and a discharge port for discharging ink, said cylinder being closed at one end, said intake port and said discharge port being located along an inner surface of the cylinder such that said discharge port has a different phase than a phase of said intake port;

providing a plunger, said main hole of said cylinder receiving said plunger such that said plunger is rotatable and movable in an axial direction, said plunger having a portion chipped off in a radial direction from one end thereof to define a cut surface portion, said cut surface portion extending in the axial direction, wherein an outer circumference of said plunger blocks said intake port and said discharge port in one phase of rotation without said cut surface portion blocking said intake port and said discharge port, said outer circumference of said plunger blocking one of said intake port and said discharge port in another phase of rotation;

providing a stepping motor for reciprocating said plunger within the main hole of said cylinder in the axial direction while rotating said plunger;

providing a motor control means for determining a number of pulses to rotate said plunger to a blocked discharge port position and for controlling the rotation of said stepping motor;

providing a pump operating means for providing a stopping instruction as output;

receiving said stopping instruction with said motor control means;

determining a phase of rotation of said plunger via said motor control means when said stopping instruction is received by said motor control means;

controlling the rotation of said stepping motor based on said number of pulses with said motor control means such that said plunger rotates to said blocked discharge port position and said stepping motor is stopped via said motor control means when said plunger is in said blocked discharge port position, said outer circumference of said plunger engaging said inner surface of said cylinder in an area of said discharge port in said blocked discharge port position such that said outer circumference prevents ink from entering said discharge port.

9. The ink method according to claim 8, wherein ink enters said main hole via said intake port when said outer circumference of said plunger blocks said discharge port such that said ink creates an ink pressure, said outer circumference of said plunger engaging said inner surface of said cylinder via said ink pressure.

* * * * *